United States Patent [19]

Kondo et al.

[11] 4,010,726

[45] Mar. 8, 1977

[54] DEVICE FOR PREVENTING AN OVERRUNNING OPERATION OF AN INTERNAL COMBUSTION ENGINE

[75] Inventors: Tetsuya Kondo, Susono; Katumasa Miyazaki, Numazu, both of Japan

[73] Assignee: Kokusan Denki Co., Ltd., Numazu, Japan

[22] Filed: July 23, 1975

[21] Appl. No.: 598,214

[52] U.S. Cl. ..... 123/148 CC; 123/102; 123/118; 123/148 S

[51] Int. Cl.[2] ..... F02P 1/00

[58] Field of Search ..... 123/102, 148 CC, 148 E, 123/118; 317/19, 31, 5

[56] References Cited

UNITED STATES PATENTS

| | | | |
|---|---|---|---|
| 3,703,889 | 11/1972 | Bodig et al. | 123/102 |
| 3,750,637 | 8/1973 | Minks | 123/148 MC |
| 3,788,421 | 1/1974 | Bozoian et al. | 173/102 |
| 3,861,372 | 1/1975 | Shibukawa et al. | 123/148 MC |
| 3,863,616 | 2/1975 | Wood | 123/148 MC |
| 3,874,349 | 4/1975 | Fitzner | 123/148 E |

*Primary Examiner*—C. J. Husar
*Assistant Examiner*—Paul Devinsky
*Attorney, Agent, or Firm*—Watson Leavenworth Kelton & Taggart

[57] ABSTRACT

A device for preventing an overrunning operation of an internal combustion engine, provided in a capacitor discharge type ignition system comprising a magneto generator including an ignition power coil and at least one loading coil and an ignition circuit including a capacitor arranged to be charged from said ignition power coil of said magneto generator, an ignition coil and a discharging thyristor so arranged that energy from said capacitor is discharged through the primary side of said ignition coil when said discharging thyristor is triggered in time with said internal combustion engine, said device comprising an ignition failing thyristor provided so as to shunt said discharging thyristor whereby a discharge current from said capacitor is prevented from flowing through said ignition coil and also means to prevent a hysteresis on repetition of failure and success to ignite said engine. The ignition failing thyristor is adapted to be triggered by a voltage responsive to the revolution number of the engine. Means to prevent the hysteresis comprises an auxiliary thyristor connected in parallel to said ignition failing thyristor and so arranged that when the ignition failing thyristor is triggered the auxiliary thyristor is also triggered whereby energy from the capacitor of said ignition circuit flows through them so that the ignition circuit is overridden.

7 Claims, 3 Drawing Figures

DEVICE FOR PREVENTING AN OVERRUNNING OPERATION OF AN INTERNAL COMBUSTION ENGINE

FIELD OF THE INVENTION

This invention pertains to a capacitor discharge type breakerless ignition system for use in an internal combustion engine, and more particularly to a device for preventing an overrunning operation of the engine adapted to override the breakerless ignition system when the engine rotates at more than a predetermined revolution number per minute.

BACKGROUND OF THE INVENTION

A device for preventing an overrunning operation of an internal combustion engine is well known which comprises an ignition failing thyristor so arranged that it is shunted across an ignition thyristor of a capacitor discharge breakerless ignition system, U.S. Pat. No. 3,703,889 discloses such a device for preventing an overrunning operation of the engine. The conventional device bears some problems which need to be solved. One of them is that a voltage produced by a revolution number detecting generator in association with the engine is not always proportional to the revolution number of the engine. In case the generator is operatively associated with a magneto of the engine, which includes a loading coil such as a lamp energizing coil and a battery charging coil as well as an ignition power coil, a voltage established across the revolution number detecting coil varies depending on whether loads act or not, because of an armature reaction of the magnetic circuit in the magneto. Furthermore, the voltage across the revolution number detecting coil also varies on demagnetization of the magnets in the magneto. Another problem is that the ignition failing thyristor has a triggering gate current varying due to its own temperature. That is, as the temperature of the thyristor decreases, larger triggering gate current must be supplied to the gate of the thyristor to trigger it. This causes the occurrence of a hysteresis on repetition of failure and success to ignite the engine. More particularly, when the revolution number per minute of the engine exceeds a predetermined value, the ignition failing thyristor permits the ignition system to be overridden. A current flowing through the ignition failing thyristor causes the pellet in the thyristor to be heated so that smaller triggering gate current triggers the ignition failing thyristor. Therefore, unless the revolution number per minute of the engine is lowered far below the predetermined value, the ignition failing thyristor cannot be turned off. As a result, the revolution number of the engine at which the ignition is resumed is different from that when it begins failure to be ignited by means of the device, resulting in a hysteresis between failure and success to ignite the engine. FIG. 1 shows a hysteresis loop produced between the conditions of failure and success to ignite the engine. Since failure to ignite the engine causes a non-combusted fuel-air compound gas to be exhausted into an exhaust pipe and a muffler of the engine, the hysteresis possibly results in more compound gas accumulated in the exhauster components. As a result, explosion may occur when the engine is reignited. Unpleasant noises may be also produced therefrom. There is an allowable width of the hysteresis loop which is adapted to control the explosion of the compound gas and to restrain unpleasant noises. A thermally responsive element which is arranged adjacent to the anode of the thyristor to detect its temperature cannot improve the hysteresis because it has a low response. Still another problem is that the components of the device is adversely affected by heat from the engine as well as that from the ignition failing thyristor. In this case, it bears no relationship to the hysteresis on the conditions of failure and success to ignite the engine, but the revolution number of the engine at which the device is operated varies as shown in FIG. 2. The curve *a* of FIG. 2 shows that as the atmosphere temperature decreases the revolution number of the engine at which the ignition failing device is operated tends to increase. In case the engine may be available for a snow mobile, it will be understood that a problem occurs just after it starts.

SUMMARY OF THE INVENTION

Accordingly, it is a principal object of the present invention to provide a device for preventing an overrunning operation of an internal combustion engine for use with a capacitor discharge type breakerless ignition system, having a characteristic excellently responsive to the revolution number of the engine and wherein a hysteresis between failure and success to ignite the engine is effectively controlled as narrow as possible.

It is another object of the present invention to provide a device for preventing an overrunning operation of an internal combustion engine as above-mentioned wherein variation in the revolution number of the engine at which the device is operated can be effectively controlled even though the ambient temperature varies.

In accordance with the present invention, there is provided a device for preventing an overrunning operation of an internal combustion engine, provided in a capacitor discharge type breakerless ignition system comprising a magneto generator including an ignition power coil and at least one loading coil and an ignition circuit including a capacitor arranged to be charged from said ignition power coil of said magneto generator, an ignition coil and a discharging thyristor so arranged that energy from said capacitor is discharged through the primary side of said ignition coil when said discharging thyristor is triggered in time with said internal combustion engine, said device comprising an ignition failing thyristor provided so as to shunt said discharging thyristor whereby a discharge current from said capacitor is prevented from flowing through said ignition coil; means to trigger said ignition failing thyristor when said engine revolves at more than a predetermined revolution number per minute, comprising a revolution number detecting generator operatively associated with said engine to produce a voltage of frequency proportional to a revolution number per minute of said engine, a first capacitor charged by said revolution number detecting generator, a second capacitor having a greater electrostatic capacity than said first capacitor and so arranged to be charged by said revolution number detecting generator, a Zener diode connected across said first and second capacitors, and an ignition failing thyristor arranged so as to shunt said discharging thyristor of said ignition circuit and so connected to said second capacitor that said ignition failing thyristor is triggered when a voltage across said second capacitor reaches a predetermined value corresponding to the maximum allowable revolution number per minute of said engine, characterized by further comprising an auxiliary thyristor connected in parallel to said ignition failing thyristor and an impedance connected in series to said ignition failing thyristor to limit a current flowing therethrough, said auxiliary thyristor having the gate connected to the cathode of said ignition failing thyristor so that a potential at the cathode of said ignition failing thyristor causes said auxiliary thyristor to be triggered.

BRIEF DESCRIPTION OF THE DRAWING

The above and other features and advantages of the present invention will become apparent to those skilled in the art from the teachings of the following description of preferred embodiment taken with reference to the accompanying drawing.

DETAILED DESCRIPTION OF PREFERRED EMBODIMENT

Figure 3:
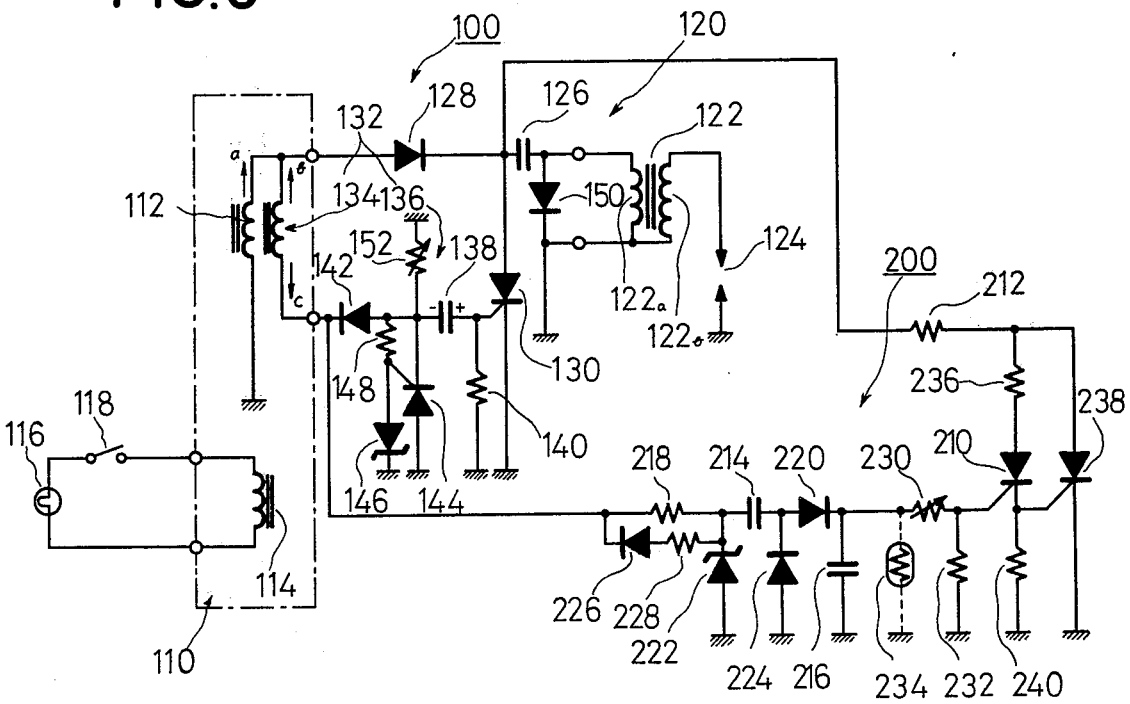
FIG. 3 is a schematic diagram of a capacitor discharge type breakerless ignition system embodying a device for preventing an overrunning operation of an internal combustion engine, in accordance with the present invention.

Referring now to FIG. 3, a capacitor discharge type breakerless ignition system for an internal combustion engine is indicated generally at numeral 100 on the left-hand side of the figure and a device preventing an overrunning operation of the engine is indicated generally at numeral 200 on the right-hand side of the figure.

The ignition system 100 comprises a flywheel type magneto generator 110 driven by an internal combustion engine (not shown) and including an ignition power coil 112 to produce ignition power having a frequency proportional to a revolution number per minute of the engine and at least one loading coil 114 disposed in magnetic association with the ignition power coil 112. In the illustrated embodiment, the loading coil 114 is shown to be used for energizing a lamp 116 through a switch 118. The coil may be used for charging a battery (not shown) Alternatively, two coils may be provided, one for energizing the lamp and the other for charging the battery. An ignition circuit 120 is provided which comprises an ignition coil 122 including a primary winding **122*a* and a secondary winding 122*b*, an ignition plug 124 connected to the secondary winding 122*b* of the ignition coil 122 and disposed in a combustion chamber of the engine, an ignition capacitor 126 at one end connected through a diode 128 to one end of the ignition power coil 112 the other end of which is grounded, to charge the capacitor 126, and at the other end of the ignition capacitor connected to one end of the primary winding 122*a* of the ignition coil 122 with the other end grounded, and a discharging thyristor 130 connected in parallel to the series connection of the capacitor 126 and the primary winding 122*a* of the ignition coil 122 for discharging the capacitor 126 through the thyristor 130 and the primary winding 122*a*. In order to trigger the discharging thyristor 130 just before the upper dead point of the piston in the cylinder, signaling means 132 is provided which may comprise an ignition signal generator 134 and a modulator 136 to modulate a signal from the generator 134. The ignition signal generator 134 may comprise a coil preferably provided in the magneto generator so as to be magnetically associated therewith. The coil of the generator 134 at one end is connected to the non-grounded end of the ignition power coil 112 and at the other end is connected to the modulator 136. The modulator may comprise a capacitor 138 charged from the one end of the signal generating coil through the ignition power coil 112 and a resistor 140 and also through a diode 142, a thyristor 144 having the cathode connected at the point of junction between the capacitor 138 and the diode 142 and the anode grounded, and a Zener diode 146 having the anode connected through a resistor 148 to the point of junction between the capacitor 138 and the diode 142 and the cathode grounded. The anode of the Zener diode 146 is also connected to the gate of the thyristor 144. Energy from the signal generator 134 is accumulated by the capacitor 138 and when a voltage across the capacitor 138 exceeds the Zener voltage of the Zener diode 146, it breaks down so that the thyristor 144 is triggered, with the result that the capacitor 138 is discharged through the resistor 140 and the thyristor 144. The resistor is connected across the gate and the cathode of the discharging thyristor 130 so that voltage drop across the resistor 140 may trigger the thyristor 130. It will be understood that a signal from the signal generator 134 may be narrow by virtue of the modulator 136. A diode 150 may be provided in parallel to the primary winding 122*a* of the ignition coil 122 for damping a primary voltage across the primary winding 122*a* of the ignition coil, as in a conventional manner. The operation of the above-described ignition system will be apparent later from the description taken in connection with the operation of the device for preventing an overrunning operation of the engine. A variable resistor 152 is provided in parallel to the thyristor 144 and serves to adjust an ignition timing of the ignition circuit 120.**

The device 200 for preventing an overrunning operation of the engine in accordance with the present invention comprises an ignition failing thyristor 210 at the anode connected through a resistor 212 to the point of junction between the ignition capacitor 126 and the diode 128. The cathode of the thyristor 210 is grounded through a resistor 240. Means to trigger the ignition failing thyristor when the engine revolves at more than a predetermined revolution number per minute is provided. It comprises a revolution number detecting generator which in the illustrated embodiment may comprise the ignition signal generator 134, and a first capacitor 214 and a second capacitor 216 arranged so as to be charged from the generator 134 through a resistor 218 and a diode 220. It also comprises a Zener diode 222 having the cathode connected to the point of junction between the resistor 218 and the capacitor 214 and the anode of the Zener diode grounded. This Zener diode serves to clip a voltage across the capacitors 214 and 216. The capacitor 214 may be arranged to be discharged through the resistor 218 and the coils 134 and 112 of the magneto 110 and through a diode 224 which has the cathode connected to the point of junction between the capacitor 214 and the diode 220 and the anode grounded. A diode 226 and a resistor 228 which are connected in series to each other, are connected in parallel to the resistor 218 to provide a lower discharging time constant to the capacitor 214. It should be noted that the second capacitor 216 has substantially greater electrostatic capacity than the first capacitor 214. The capacitors 214 and 216 and the diodes 220 and 224 constitute an integration circuit which serves to establish across the second capacitor 216 a voltage proportional to a frequency of the output from the revolution number detecting generator, i.e., the revolution number per minute of the engine. The capacitor 216 may be arranged to be discharged through a variable resistor 230 and also through a resistor 232, one end of which is connected to the gate of the ignition thyristor 210 and the other end of which is grounded. The variable resistor 230 serves to determine a revolution number per minute of the engine at which the device 200 is operated. A thermister 234 may be provided so that one of its end is connected to the point of junction between the capacitor 216 and the variable resistor 230 and the other end is grounded. The thermister 234 serves to correct the temperature charcteristic of the ignition failing thyristor 210 as described later.

The ignition failing thyristor 210 has a resistor 236 of high impedance connected in series thereto on the anode side thereof so as to limit a current flowing therethrough. An auxiliary thyristor 238 is provided in parallel to the series connection of the resistor 236 and the thyristor 210 so as to shunt a current from the ignition capacitor 126. The cathode of the thyristor 238 may be grounded. The point of junction between the cathode of the thyristor 210 and the resistor 240 is connected to the gate of the auxiliary thyristor 238. Thus, when the ignition failing thyristor is caused to turn on a current from the ignition capacitor 126 flows through the ignition failing thyristor 210 and in turn a voltage drop across the resistor 240 causes the auxiliary thyristor 238 to turn on so that it shorts a current fom the ignition capacitor 126 whereby the ignition circuit 120 is overridden.

In operation, when the engine begins to rotate, one half-wave of an ignition power from the ignition power coil 112 of the magneto generator 110 in the direction indicated by an arrow *a* of FIG. 3 causes the ignition capacitor 126 to be charged through the forwarded diode 128 until the capacitor 126 has a given voltage established thereacross. While the capacitor 126 is maintained at the given voltage, one half-wave of a signal from the signal generator 134 indicated by an arrow *b* of FIG. 3 charges the capacitor 138 through the ignition power coil 112 and the resistor 140 as above-mentioned. As a voltage across the capacitor 138 reaches the Zener voltage of the Zener diode 146, the discharging thyristor 130 is triggered so that the capacitor 126 is abruptly discharged through the thyristor 130 and the primary winding 122*a* of the ignition coil 122. Thus, a high voltage is established across the secondary winding 122*b* of the ignition coil 122 so that the ignition plug 124 is sparked for igniting the engine.

The other half-wave of the signal from the generator 134 indicated by an arrow *c* of FIG. 3 charges the first and second capacitors 214 and 216 through the resistor 218 and the diode 220. While the capacitor 214 is discharged during every one half-wave of the signal from the generator 134 indicated by the arrow *b*, the capacitor 216 has a voltage proportional to the revolution number per minute of the engine by its storage effect, because the ignition signal generator has a voltage of frequency equal to the revolution number per minute of the engine. When the r.p.m. of the engine exceeds the allowable value so that a voltage across the second capacitor 216 exceeds a predetermined value, sufficient gate current to trigger the ignition failing thyristor 210 flows through its gate and cathode to thereby achieve conduction of the same when forwarded voltage is applied thereacross. The conduction of the ignition failing thyristor 210 causes the auxiliary thyristor 238 to turn on so that a current from the ignition capacitor 126 is shorted from flowing through the discharging thyristor 130 and the ignition coil 122. Thus, the ignition circuit 120 is overridden so that the engine fails to be ignited. Such failure to ignite the engine causes decrease in the r.p.m. of the engine and therefore, lowers a voltage across the second capacitor 216, with the result that the device 200 is not operated.

Figure 1:
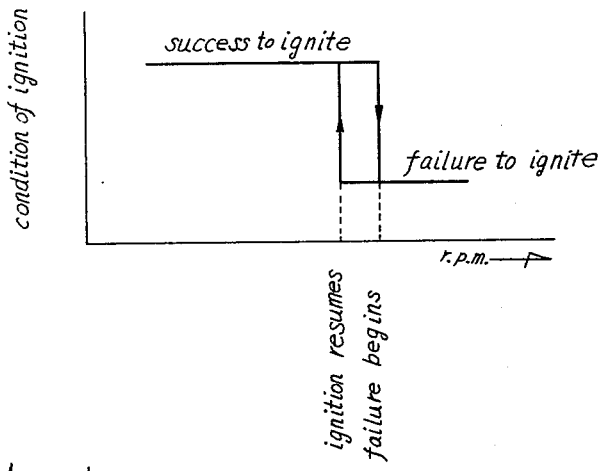
FIG. 1 shows a hysteresis which occurs between the conditions of failure and success to ignite an internal combustion engine.

It should be noted that only slight current flows through the ignition failing thyristor 210, therefore less heat, is produced from the pellet of the thyristor. Thus, no variation occurs in the gate of the thyristor 210 adapted to trigger it and therefore, a hysteresis as shown in FIG. 1 is never produced in accordance with the device of the present invention. By way of example, in case the auxiliary thyristor 238 and the resistor 236 are omitted, a width in the hysteresis corresponds to 200 to 300 r.p.m., but the device of the present invention can control the width in the hysteresis until it corresponds to 50 r.p.m.. Such a narrow width in the hysteresis substantially restrains the fuel-air compound gas from being accumulated in the exhaust pipe and the muffler of the engine. While failure to ignite the engine continues one or two cycles of the engine, the r.p.m. of the engine is lowered in a degree of about 50 r.p.m. and the ignition of the engine is resumed. Thus, failure and success to ignite the engine is repeated 10 or more times per second. It will be understood that no unpleasant noises are produced from the exhaust system of the engine and that no explosion occurs.

Figure 2:
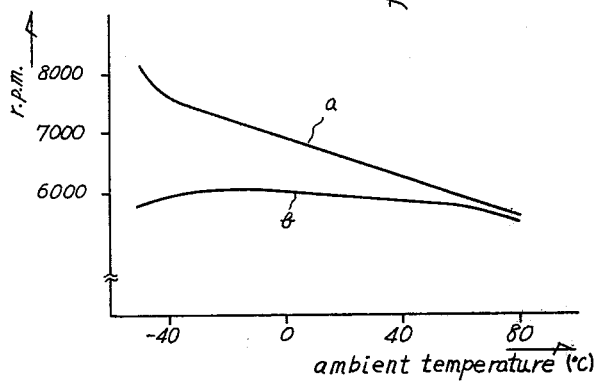
FIG. 2 is a graph showing variation in the revolution number per minute at which an ignition failing device is operated, as against the ambient temperature.

In order to prevent variation in the r.p.m. of the engine at which the device 200 is operated due to the ambient temperature of the ignition failing thyristor 210, the capacitor 214 may preferably comprise a plastic film condenser such as a polyester film condenser having low variation such as loss than 10% in the capacitance against variation in the ambient temperature from −40° to + 80° C. Alternatively, it may preferably comprise a condenser having such a characteristic that its capacitance decreases as the ambient temperature becomes higher. On the other hand, the capacitor 216 may preferably comprise a condenser such as a chemical condenser having such a characteristic that its capacitance decreases at lower ambient temperature and that it increases at higher ambient temperature. Thus, if the ambient temperature is higher, the voltage across the capacitor decreases so that the triggering gate current becomes lower, so that variation in the r.p.m. of the engine at which the device is operated can be controlled. Generally, the temperature characteristic of the capacitor 216 is dependent on variation in the temperature characteristic of the capacitor 214 and of the ignition failing thyristor 210. The thermister 234 can correct the temperature characteristic of the thyristor 210. A curve *b* of FIG. 2 shows the temperature-r.p.m. characteristic of the device 200 of the present invention as shown in FIG. 3.

While a preferred embodiment of the present invention has been described and illustrated with reference to the accompanying drawing, it will be understood that various modifications and changes in arrangement may be made without departing from the spirit and scope of the invention, which is intended to be defined only to the appended claims.

What is claimed is:

1. A device for preventing an overrunning operation of an internal combustion engine, provided in a capacitor discharge type breakerless ignition system comprising a magneto generator including an ignition power coil and at least one loading coil and an ignition circuit including a capacitor charged from said ignition power coil of said magneto generator, an ignition coil and a discharging thyristor, energy from said capacitor being discharged through the primary side of said ignition coil when said discharging thyristor is triggered in time with said engine, said device comprising an ignition failing thyristor shunting said discharging thyristor whereby a discharge current from said capacitor is prevented from being supplied to said ignition coil; means to trigger said ignition failing thyristor when said engine revolves at more than a predetermined revolution number per minute, including a revolution number detecting generator providing a voltage indicative of the revolution number per minute of said engine, a first capacitor charged by said revolution number detecting generator, and a second capacitor having a greater electrostatic capacity than said first capacitor and also charged by said revolution number detecting generator, a Zener diode connected across said first and second capacitors, said ignition failing thyristor being connected to said second capacitor whereby said ignition failing thyristor is triggered when the voltage across said second capacitor reaches a predetermined value corresponding to the maximum allowable revolution number per minute of said engine, and an auxiliary thyristor connected in parallel to said ignition failing thyristor and an impedance connected in series with said ignition failing thyristor to limit current flow therethrough, said auxiliary thyristor having the gate thereof connected to the cathode of said ignition failing thyristor whereby a potential at the cathode of said ignition failing thyristor causes said auxiliary thyristor to be triggered.

2. A device as set forth in claim 1, wherein said ignition circuit comprises an ignition signal generator magnetically operated by said magneto generator to produce a signal to trigger said discharging thyristor.

3. A device as set forth in claim 1, wherein said impedance comprises a resistor.

4. A device as set forth in claim 1, and further comprising thermally responsive resistor means for compensating temperature characteristic change of said ignition failing thyristor.

5. A device as set forth in claim 1, and further comprising a variable resistor connected between said second capacitor and said gate of said ignition failing thyristor whereby said voltage triggering said ignition failing thyristor may be varied to vary the revolution number per minute of said engine at which said device is operated.

6. A device as set forth in claim 1, wherein said first capacitor is of type exhibiting substantially no variation in capacitance with change in ambient temperature and said second capacitor is of type exhibiting capacitance increasing with increasing ambient temperature.

7. A device as set forth in claim 1, wherein said first capacitor is of type exhibiting capacitance decreasing with increasing ambient temperature and said second capacitor is of type exhibiting capacitance increasing with increasing ambient temperature.

* * * * *